US005303799A

United States Patent [19]

Tsai

[11] Patent Number: 5,303,799

[45] Date of Patent: Apr. 19, 1994

[54] EMERGENCY ESCAPE DEVICE

[76] Inventor: Hsin-Tan Tsai, No. 50-8, Fu-Hsing St., Hualien City, Taiwan

[21] Appl. No.: 66,572

[22] Filed: May 25, 1993

[51] Int. Cl.[5] ..... E06C 9/14

[52] U.S. Cl. ..... 182/78; 182/74; 182/70

[58] Field of Search ..... 182/77-81, 182/70, 74, 84

[56] References Cited

U.S. PATENT DOCUMENTS 2,840,289 6/1958 Murray ..... 182/70 X
3,692,145 9/1972 Banner ..... 182/78 X
3,847,246 11/1974 Banner ..... 182/78

*Primary Examiner*—Alvin C. Chin-Shue
*Attorney, Agent, or Firm*—Woodcock Washburn Kurtz Mackiewicz & Norris

[57] ABSTRACT

An emergency escape device for a building wall includes an emergency door mechanism and a control assembly. The emergency door mechanism includes a door panel, a ladder, a rigid support arm and a driving assembly. The door panel is mounted pivotally on the wall and is movable relative to the wall between a closed position, wherein the door panel is flush with the wall, and an open position, wherein the door panel is perpendicular to the wall. The ladder has an upper end which is connected pivotally to the upper end of the door panel and a lower end which extends to the ground surface when the door panel is located in the open position. The support arm is mounted pivotally on the wall below the lower end of the door panel at one end and is connected pivotally to the ladder at the other end thereof so as to prevent swaying of the ladder when the door panel is in the open position. The driving assembly is operable to move the door panel between the closed and open positions. The control assembly is connected electrically to the driving assembly and is operable to activate the driving assembly.

3 Claims, 5 Drawing Sheets

EMERGENCY ESCAPE DEVICE

BACKGROUND OF THE INVENTION

1. Field of The Invention

This invention relates to an emergency escape device for a building, more particularly to an emergency escape device which permits the escape of people from a building during emergency conditions.

2. Description of the Related Art

In general, a building is provided with conventional fire-fighting facilities such as fire alarms, sprinklers, emergency exits, etc., so that the people in the building can escape therefrom via the emergency exits when the building is on fire. Sometimes, the doors of the emergency exits are blocked and thus, people in the building cannot escape until the firemen arrive. Furthermore, it is common for some people to panic and escape from the building by jumping out of a window, thereby increasing the number of casualties in a fire.

SUMMARY OF THE INVENTION

Therefore, the main object of the present invention is to provide an emergency escape device that is installed on the wall of a building and that can be operated automatically so as to allow the escape of people from the building during emergency conditions.

According to this invention, an emergency escape device for a building wall includes an emergency door mechanism and a control assembly. The emergency door mechanism includes a door panel, a ladder, a rigid support arm and a driving assembly. The door panel has an upper end and a lower end which is mounted pivotally on the wall and which is displaced from a ground surface by a predetermined height. The door panel is movable relative to the wall between a closed position, wherein the door panel is flush with the wall, and an open position, wherein the door panel is perpendicular to the wall. The ladder has an upper end connected pivotally to the upper end of the door panel and a lower end which extends to the ground surface when the door panel is located in the open position. The support arm is mounted pivotally on the wall below the lower end of the door panel at one end and is connected pivotally to the ladder at the other end thereof so as to prevent swaying of the ladder when the door panel is in the open position. The driving assembly is operable to move the door panel between the closed and open positions and includes a motor unit with a driving shaft, a vertical shaft which is disposed adjacent to one side of the door panel at an inner side of the door panel and which is driven rotatably by the driving shaft of the motor unit, two horizontal shafts which are adjacent to a respective one of the upper and lower ends of the door panel at the inner side of the door panel and which are driven rotatably by the vertical shaft. The driving assembly further includes a string unit which is connected securely to an upper one of the horizontal shafts at one end and which is connected securely to the upper end of the door panel at the other end, rotation of the upper one of the horizontal shafts in one direction winding the string unit thereon to pull the door panel from the open position to the closed position, and a curved push rod having one end mounted securely on a lower one of the horizontal shafts and a distal end abutting against the door panel to push the door panel from the closed position to the open position. The control assembly is connected electrically to the motor unit of the driving assembly and is operable so as to activate the motor unit of the driving assembly.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
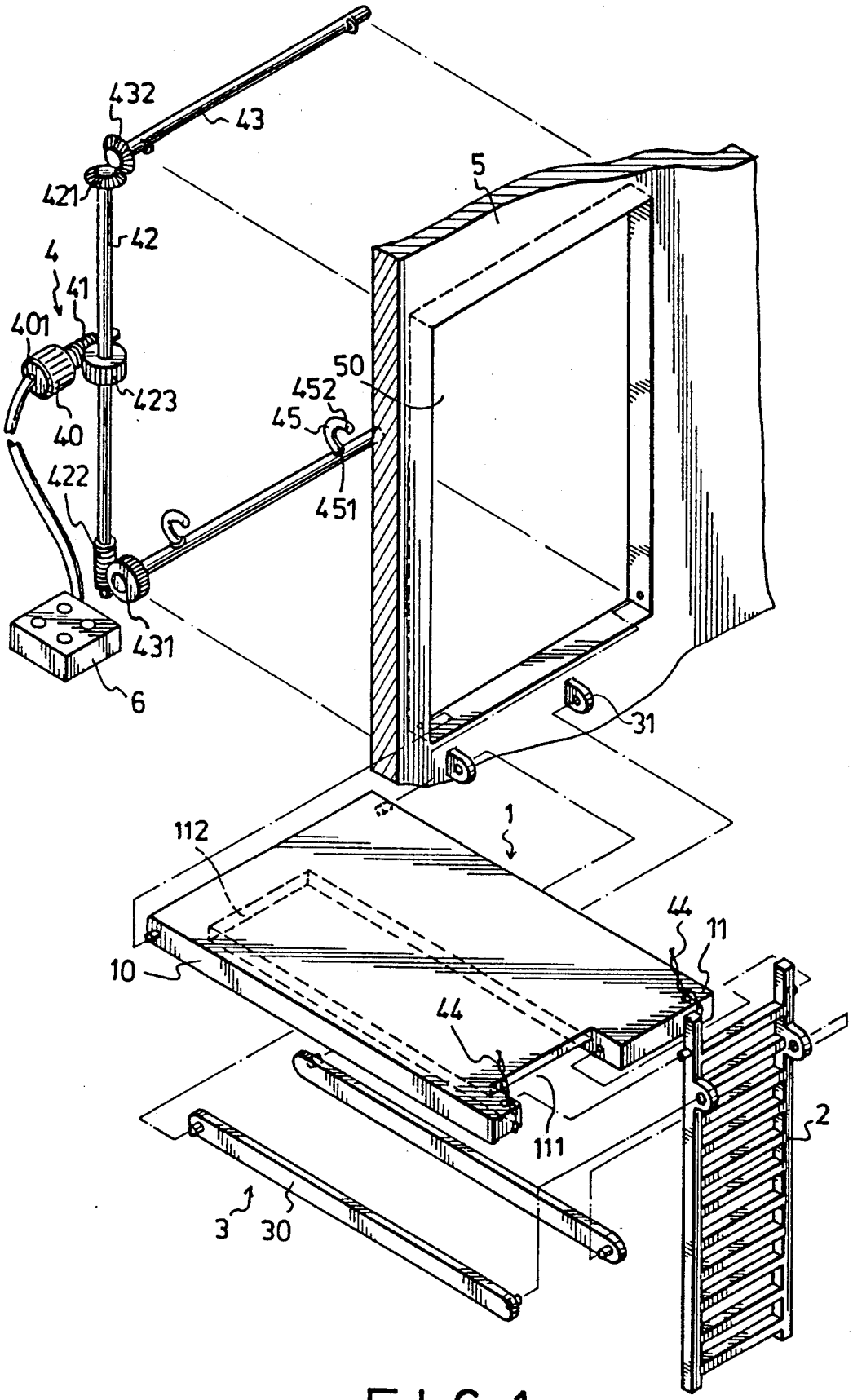
FIG. 1 is an exploded view showing an emergency door mechanism of an emergency escape device according to the present invention.
Figure 2:
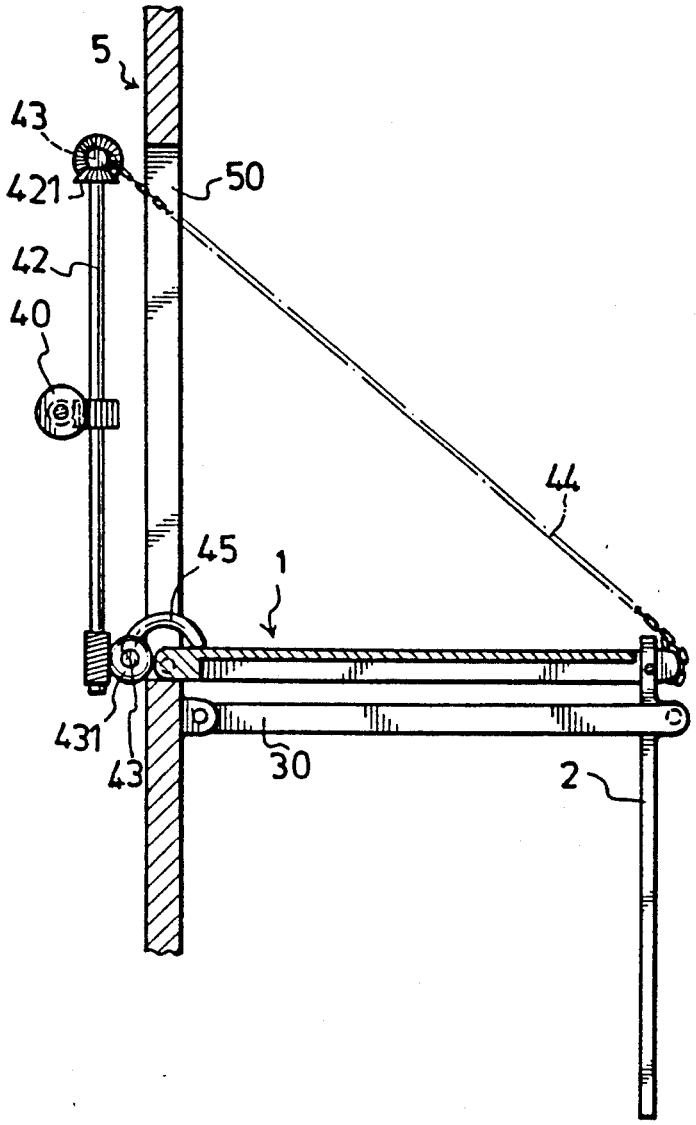
FIG. 2 is a partly sectional side view of the emergency door mechanism of the emergency escape device according to the present invention when the door mechanism is mounted on the wall.
Figure 5:
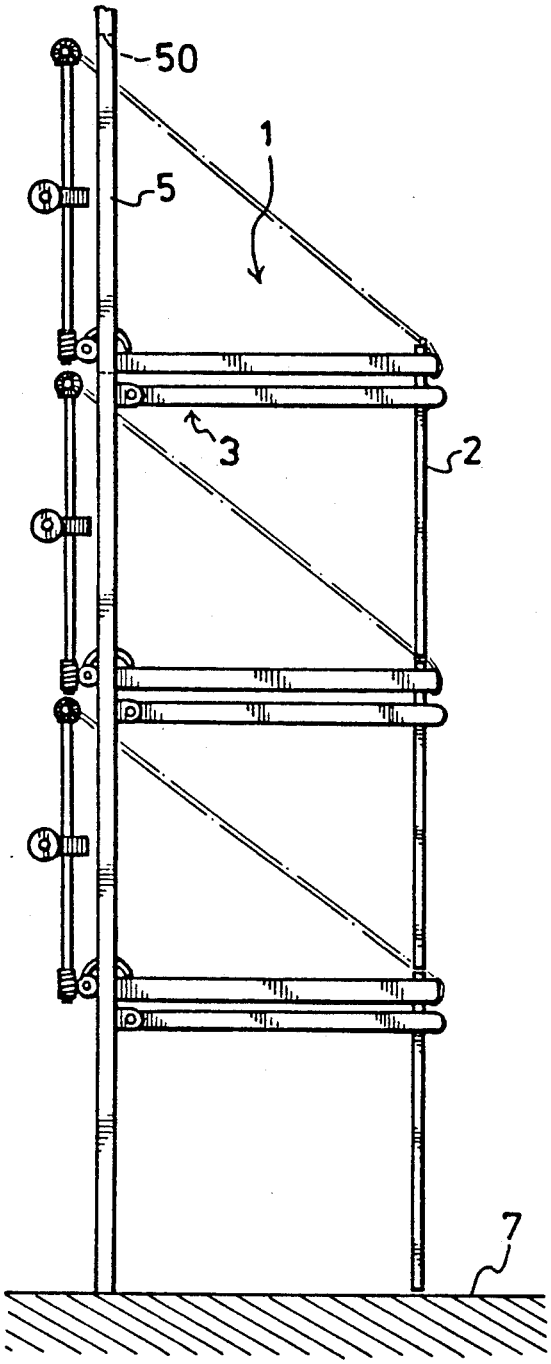
FIG. 5 is a fragmentary side view showing the emergency escape device which is installed on a building wall and which includes a plurality of emergency door mechanisms.

Referring to FIGS. 1, 2 and 5, the building wall (5) of a building (not shown) with at least two floors has a hole (50) formed therein between each two successive floors of the building. Each of the holes (50) are vertically aligned with each other. An emergency escape device according to this invention includes a plurality of emergency door mechanisms which are mounted on the wall (5) of the building to close a respective one of the holes (50) in the wall (5), and a control assembly (6). Each of the emergency door mechanisms includes a door panel (1), a ladder (2), a rigid support frame (3) and a driving assembly (4).

The door panel (1) has an upper end (11) and a lower end (10). The lower end (10) of the door panel (1) is mounted pivotally on the wall (5). As best illustrated in FIG. 5, the lower end (10) of the door panel (1) of the lowermost one of the door mechanisms is displaced from the ground surface (7) by a predetermined height. The door panel (1) is movable relative to the wall (5) between a closed position, wherein the door panel (1) fills the hole (50) and is flush with the wall (5), and an open position, wherein the door panel (1) is perpendicular to the wall (5). The lower end (10) of the door panel (1) of an upper one of the door mechanisms is displaced from the lower end (10) of the door panel (1) of an adjacent lower one of the door mechanisms by the predetermined height. The upper end (11) of the door panel (1) has a notch (111) formed thereat. A chamber (112) is formed in an outer surface of the panel (1) adjacent to the notch (111).

The ladder (2) has an upper end connected pivotally to the upper end (11) of the door panel (1) inside the notch (111) and a lower end. The ladder (2) is pivoted perpendicularly to the door panel (1) due to gravity when the door panel (1) is in the open position. As best shown in FIG. 5, the lower end of the ladder (2) of the lowermost one of the door mechanisms extends to the ground surface (7) when the door panel (1) is in the open position. The lower end of the ladder (2) of an upper one of the door mechanisms extends toward the door panel (1) of the adjacent lower one of the door mechanisms when the door panel (1) of the door mechanisms are in the open position. When the door panel (1) is in the closed position, the door panel (1) receives the ladder (2) in the chamber (12). The lengths of the ladders (2) of the door mechanisms are equal and are sufficient for a person to climb down from the door panel (1) of an upper one of the door mechanisms to the door panel (1) of the adjacent lower one of the door mechanisms.

Two horizontally aligned and spaced pivot seats (31) are fixed on the wall (5) below the lower end (10) of the door panel (1). The support arm (3) includes two elongated parallel arm sections (30) which are connected respectively to the pivot seats (31) at one end and which are connected pivotally to the ladder (2) at the other end so as to prevent swaying of the ladder (2) when the door panel (1) is in the open position.

The driving assembly (4) is operable so as to move the door panel (1) between the closed and open positions and includes a motor unit (40) with a driving shaft (401), a vertical shaft (42), two horizontal shafts (43), a string unit (44) and two curved push rods (45). The driving shaft (401) of the motor unit (40) has a gear (41) mounted securely thereon so that the gear (41) rotates synchronously with the driving shaft (401) when the motor unit (40) is activated. The vertical shaft (42) is disposed adjacent to one side of the door panel (1) at an inner side of the door panel (1) and has a cog (423) which is mounted axially on a middle portion thereof and which engages rotatably the gear (41) of the driving shaft (401) of the motor unit (40). The vertical shaft (42) further has a bevel gear (421) mounted axially on the upper end thereof and a worm gear (422) mounted on the lower end thereof. One of the horizontal shafts (43) is disposed adjacent to the upper end (11) of the door panel (1) at the inner side of the door panel (1), while the other one of the horizontal shafts (43) is disposed adjacent to the lower end (10) of the door panel (1) at the inner side of the door panel (1). The upper one of the horizontal shafts (43) has a bevel gear (432) which is mounted axially on an end thereof and which engages rotatably the bevel gear (421) on the vertical shaft (42) such that the upper one of the horizontal shafts (43) rotates synchronously with the vertical shaft (42). The lower one of the horizontal shafts (43) has a cog (431) which is mounted axially on an end thereof and which engages rotatably the worm gear (422) of the vertical shaft (42) so that the lower one of the horizontal shafts (43) rotates synchronously with the vertical shaft (42). The string unit (44) includes two string members which are connected to the upper one of the horizontal shafts (43) at one end and which are connected to the upper end (11) of the door panel (1) at the other end. When the upper one of the horizontal shafts (43) is driven by the vertical shaft (42) to rotate in one direction, the rotation of the upper one of the horizontal shafts (43) winds the string unit (44) thereon so as to pull the door panel (1) from the open position to the closed position. Each of the push rods (45) has one end (451) mounted securely on the lower one of the horizontal shafts (43) and a distal end (452) abutting against the door panel (1) so as to push the door panel (1) from the closed position to the open position when the lower one of the horizontal shafts (43) rotates.

The control assembly (6) is connected electrically to the motor unit (40) of the driving assembly (4) of each emergency door mechanism and is operable to activate simultaneously the motor unit (40) of the driving assembly (4) of each door mechanism. In the preferred embodiment, the control assembly (6) is connected electrically to a fire alarm (not shown) in the building such that the control assembly (6) receives a signal from the fire alarm to activate the door mechanisms at the same time when the fire alarm is activated.

Figure 3:
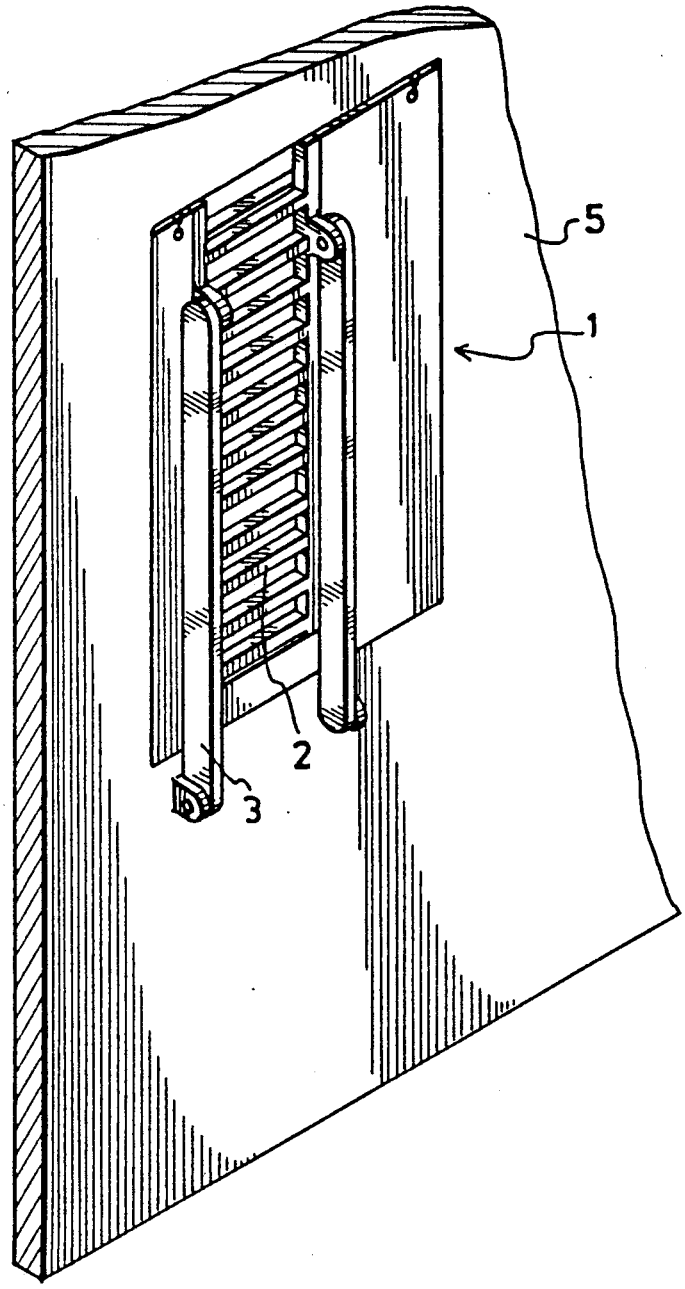
FIG. 3 is a perspective view of the emergency escape device according to the present invention when the door panel of the emergency door mechanism of the emergency escape device is in the closed position.

Referring to FIG. 3, when the door mechanisms of the emergency escape device according to the present invention is not in use, the string unit (44) is wound on the upper one of the horizontal shafts (43) in order to pull the corresponding door panel (1) and retain the latter in the closed position. The ladder (2) is retained in the chamber (112) of the door panel (1) due to gravity at this stage.

Figure 4:
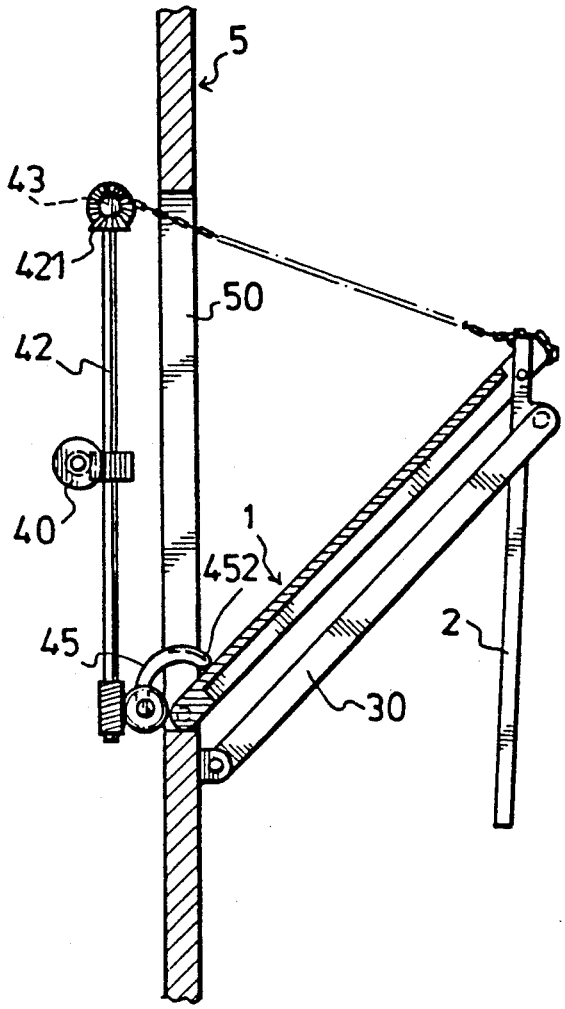
FIG. 4 is a partly sectional side view showing the emergency escape device according to the present invention when the door panel of the emergency door mechanism of the emergency escape device is between the open and closed positions.

Referring to FIG. 4, when the control assembly (6) is activated so as to operate the driving assemblies (4) of the door mechanisms when the building is on fire, the driving shaft (401) of the motor unit (40) of the driving assembly (4) of each door mechanism rotates so as to rotate therewith the vertical shaft (42) and the horizontal shafts (43). At this stage, the upper one of the horizontal shafts (43) is rotated to unwind the string unit (44) thereon so as to permit the door panel (1) to move from the closed position to the open position when the door panel (1) is pushed by the push rods (45) due to the rotation of the lower one of the horizontal shafts (43).

The control assembly (6) and the driving assemblies (4) of the emergency escape device of the present invention can be connected electrically to a conventional uninterrupted power supply system (not shown) so that operation of the control assembly (6) and the driving assemblies (4) remains possible even though power failure has occurred. Furthermore, the door panels (1) of the door mechanisms can be operated individually so as to serve as a terrace for lifting articles into and out of the building.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An emergency escape device for a building wall, characterized by:

a first emergency door mechanism including a door panel having an upper end and a lower end which is mounted pivotally on said wall and which is displaced from a ground surface by a predetermined height, said door panel being movable relative to said wall between a closed position, wherein said door panel is flush with said wall, and an open position, wherein said door panel is perpendicular to said wall, a ladder having an upper end connected pivotally to said upper end of said door panel and a lower end which extends to the ground surface when said door panel is located in said open position, a rigid support arm mounted pivotally on said wall below said lower end of said door panel at one end and connected pivotally to said ladder at the other end thereof, said support arm preventing swaying of said ladder when said door panel is in said open position, and a driving assembly which is operable to move said door panel between said closed and open positions and which includes a motor unit with a driving shaft, a vertical shaft which is disposed adjacent to one side of said door panel at an inner side of said door panel and which is driven rotatably by said driving shaft of said motor unit, two horizontal shafts which are adjacent to a respective one of said upper and lower ends of said door panel at said inner side of said door panel and which are driven rotatably by said vertical shaft, said driving assembly further including a string unit connected securely to an upper one of said horizontal shafts at one end and connected securely to said upper end of said door panel at the other end, rotation of said upper one of said horizontal shafts in one direction winding said string unit thereon to pull said door panel from said open position to said closed position, and a curved push rod having one end mounted securely on a lower one of said horizontal shafts and a distal end abutting against said door panel to push said door panel from said closed position to said open position; and a control assembly connected electrically to said motor unit of said driving assembly and operable to activate said motor unit of said driving assembly.

2. An emergency escape device as claimed in claim 1, characterized in that said door panel has an outer surface formed with a chamber to receive said ladder when said door panel is in said closed position.

3. An emergency escape device as claimed in claim 1, further characterized by a second said emergency door mechanism which is mounted on said building wall above said first said emergency door mechanism and which is driven operably by said control assembly, said lower ends cf said door panels of said first and second said emergency door mechanisms being displaced by a predetermined height, said lower end of said ladder of said second said emergency door mechanism extending toward said door panel of said first said emergency door mechanism when said door panels of said first and second said emergency door mechanisms are in said open position.

* * * * *